United States Patent [19]

Fehrer

[11] 4,148,177

[45] Apr. 10, 1979

[54] APPARATUS FOR SPINNING TEXTILE FIBERS

[76] Inventor: Ernst Fehrer, Auf der Gugl 28, A-4020 Linz, Austria

[21] Appl. No.: 917,016

[22] Filed: Jun. 19, 1978

[30] Foreign Application Priority Data

Jul. 13, 1977 [AT] Austria ..... 5020/77

[51] Int. Cl.[2] ..... D01H 1/12

[52] U.S. Cl. ..... 57/58.89; 57/58.95

[58] Field of Search ..... 57/58.89–58.95, 50, 57/156; 19/150, 157

[56] References Cited

U.S. PATENT DOCUMENTS

| | | | |
|---|---|---|---|
| 3,636,693 | 1/1972 | Benson et al. | 57/50 |
| 3,913,310 | 10/1975 | Fehrer | 57/156 |
| 3,972,173 | 8/1976 | Fehrer | 57/58.89 |
| 3,981,137 | 9/1976 | Fehrer | 57/156 |
| 4,051,653 | 10/1977 | Mitteregger | 57/58.89 |
| 4,060,966 | 12/1977 | Konig | 57/58.89 |

*Primary Examiner*—John Petrakes
*Attorney, Agent, or Firm*—Kurt Kelman

[57] ABSTRACT

Juxtaposed, closely spaced, first and second drums are provided, one of which is approximately as large as the other. Said drums define between them a triangular space adapted to receive textile fibers approaching on one side of said drums in a freely flying state. Suction-exerting means are provided only in said first drum and operable to subject said fibers in said triangular space to suction. Said first drum has a suction zone adjoining said triangular space and communicating with said suction-exerting means. Said second drum has a structured outside peripheral surface. The first and second drums are operable to rotate in the same sense so that said first drum revolves away from said triangular space and said second drum revolves toward said triangular space on said one side of said drums so that said fibers received in said triangular space and subjected to suction therein through said suction zone are twisted together to form a yarn when said first and second drums are thus rotated. Said apparatus also comprises means for withdrawing said yarn toward one end of each of said first and second drums while holding said yarn against rotation.

2 Claims, 3 Drawing Figures

APPARATUS FOR SPINNING TEXTILE FIBERS

Figure 1:
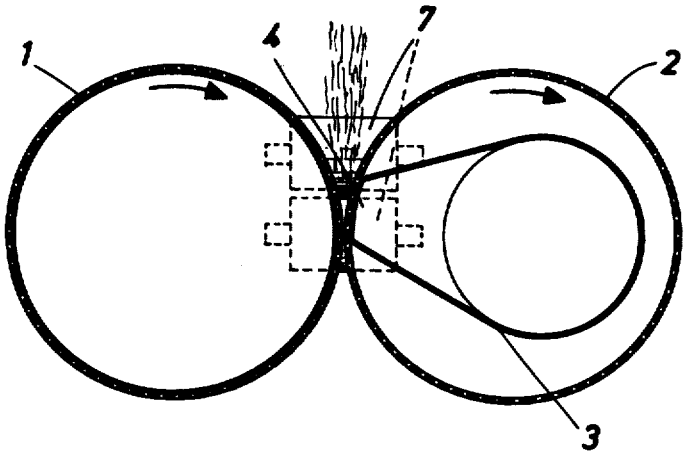

This invention relates to apparatus for spinning textile fibers comprising two juxtaposed, closely spaced drums, which rotate in the same sense and each of which is approximately as large as the other and which define between them a triangular space into which fibers which approach in a freely flying state are subjected to suction and twisted together to form a spun yarn, which is withdrawn toward one end of each of the drums and is simultaneously held against rotation.

In a known apparatus of that kind (Austrian Patent specification No. 333,631), each drum is provided with a suction insert and thus constitutes a suction drum, and the suction zones of the drums face each other and adjoin the triangular space. That known apparatus has proved to be satisfactory and compared to other open-end spinning apparatus affords the advantage of being simpler in structure and enabling a withdrawal of the yarn at higher speed and permitting of a spinning of fibers which otherwise cannot be processed by open-end spinning. On the other hand, it has been found that fine or low-denier fibers which can easily be twisted cannot always be spun to form a soft, bulky yarn but the spun yarn may be too compact or too firmly twisted, depending on the properties of the fibers.

It is an object of the invention so to improve the apparatus described first hereinbefore that even fine fibers, which can easily be twisted, can be spun to form soft, bulky yarns and that the structural expenditure is reduced.

This object is accomplished according to the invention in that only the drum which revolves away from the triangular space on the side on which the fibers approach constitutes a suction drum having a suction zone which adjoins the triangular space whereas the other drum has a structured surface, e.g., a surface which is formed with recesses.

In the apparatus according to the invention the forces which tend to pull the fibers into the nip or into the inner portion of the triangular space between the two drums are decreased in strength because that drum which revolves toward the triangular space in the region in which the fibers impinge has no suction zone but a structured surface which tends to carry along the fibers. The action exerted by the other drum, which consists of a suction drum, on the fibers being twisted together predominates and the fibers are not twisted together in the inner portion of the triangular space but near the outer portion of said space so that the resulting yarn is more fluffy and when low-denier fibers are being spun, is more adapted to the fibers. Because one of the drums does not constitute a suction drum, the need for a suction insert and a vacuum fitting for that drum is eliminated so that the structural expenditure is reduced. The drum having a structured surface may have a shell formed with blind bores. Alternatively, the drum may have the same shell as the suction drum and the perforations in the shell may be covered on the inside of the drum by a liner of plastic sheeting. It will be understood that other measures may be adopted to avoid the presence of an entirely smooth drum shell, which would result in an insufficient twisting action.

Figure 2:
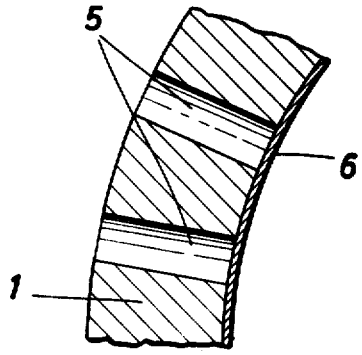
Figure 3:
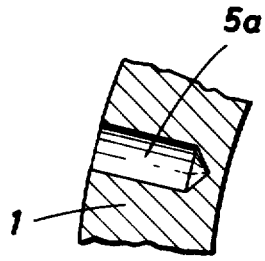

The subject matter of the invention is shown by way of example on the accompanying drawing, in which FIG. 1 is a diagrammatic transverse sectional view taken through the two drums and showing the most essential parts of a spinning apparatus and FIGS. 2 and 3 are enlarged sectional views showing portions of the shell of the non-sucking drum.

The fibrous material is disintegrated into individual fibers, which are fed in a freely flying state into a triangular space between two juxtaposed, closely spaced drums 1, 2, which are equal in size and rotate in the same sense. Of these two drums 1, 2, only the drum 2 is provided with a suction insert 3 and thus constitutes a suction drum, which has a suction zone 4 adjoining the triangular space between the two drums 1, 2. The drum 1 which revolves toward the triangular space on the side on which the fibers approach has merely a structured surface. To that end, the shell of the drum 1 is formed with bores 5, 5*a*. The through bores 5 (FIG. 2) are covered on the inside of the drum by a paper 6 and the bores 5*a* (FIG. 3) consist of blind bores.

The fibers flying into the triangular space between the drums 1, 2 are twisted together by the rotating drums 1, 2 and are withdrawn by means of a pair of rollers 7 toward one end of the drums. The rollers 7 prevent a rotation of the spun thread about its axis.

What is claimed is:

1. Apparatus for spinning textile fibers comprising juxtaposed, closely spaced, first and second drums, one of which is approximately as large as the other and which define between them a triangular space adapted to receive textile fibers approaching on one side of said drums in a freely flying state, suction-exerting means provided only in said first drum and operable to subject said fibers in said triangular space to suction, said first drum having a suction zone adjoining said triangular space and communicating with said suction-exerting means, said second drum having a structured outside peripheral surface, said first and second drums being operable to rotate in the same sense to that said first drum revolves away from said triangular space and said second drum revolves toward said triangular space on said one side of said drum so that said fibers received in said triangular space and subjected to suction therein through said suction zone are twisted together to form a yarn when said first and second drums are thus rotated;

said apparatus further comprising means for withdrawing said yarn toward one end of each of said first and second drums while holding said yarn against rotation.

2. Apparatus as set forth in claim 1, in which said outside peripheral surface of said second drum is formed with recesses.

* * * * *